US005373785A

United States Patent [19]

Yamamoto et al.

[11] Patent Number: 5,373,785

[45] Date of Patent: Dec. 20, 1994

[54] MIMEOGRAPHIC TRANSFER PRINTING MACHINE

[75] Inventors: Yasuo Yamamoto, Tsuchiura; Mitsuru Ujiie, Ushiku; Nagon Takita, Tsuchiura, all of Japan

[73] Assignee: Riso Kagaku Corporation, Tokyo, Japan

[21] Appl. No.: 96,070

[22] Filed: Jul. 23, 1993

[30] Foreign Application Priority Data

Jul. 30, 1992 [JP] Japan ..... 4-204012

[51] Int. Cl.[5] ..... B41F 15/08; B41F 15/22

[52] U.S. Cl. ..... 101/116; 101/118; 101/119; 101/492

[58] Field of Search ..... 101/116, 36, 117, 118, 101/119, 120, 121, 122, 177, 217, 492

[56] References Cited

U.S. PATENT DOCUMENTS

| | | | |
|---|---|---|---|
| 3,685,442 | 8/1972 | Harwell, Jr. | 101/119 |
| 3,915,087 | 10/1975 | Tiemann | 101/116 |
| 4,509,454 | 4/1985 | Vertegaal | 101/119 |
| 4,791,866 | 12/1988 | Kanno et al. | 101/118 |
| 4,885,992 | 12/1989 | Duce | 101/120 |
| 5,090,312 | 2/1992 | Ohinata | 101/116 |
| 5,142,981 | 9/1992 | Dettinger et al. | 101/247 |

FOREIGN PATENT DOCUMENTS

| | | | |
|---|---|---|---|
| 2040567 | 2/1971 | Germany | 101/119 |
| 144069 | 6/1988 | Japan | 101/122 |
| 7707997 | 1/1979 | Netherlands | 101/119 |
| 7812604 | 7/1980 | Netherlands | 101/119 |

*Primary Examiner*—Edgar S. Burr
*Assistant Examiner*—Stephen R. Funk
*Attorney, Agent, or Firm*—Kanesaka & Takeuchi

[57] ABSTRACT

A mimeographic transfer printing machine includes a stencil support drum for supporting a stencil, an ink supply device for forcing ink through the stencil supported on the stencil support drum, an ink receiving transfer drum to which the ink forced out from the stencil is to be transferred, and a sheet support device for supporting a printing sheet to which the ink on the ink receiving transfer drum is to be transferred. The stencil support drum has a slightly larger diameter than the transfer drum so that the circumferential speed of the stencil support drum is greater than that of the transfer drum to provide to the stencil a tension acting in a direction opposite to the rotation of the stencil support drum.

3 Claims, 1 Drawing Sheet

MIMEOGRAPHIC TRANSFER PRINTING MACHINE

BACKGROUND OF THE INVENTION

1. Field of the Invention

This invention relates to a rotary mimeographic transfer printing machine using a stencil.

2. Description of the Related Art

A typical conventional rotary mimeographic printing machine has a master drum for supporting a stencil on its outer circumferential surface. The master drum is rotatable and is equipped with an ink supply means inside the drum. A pressure roller is situated adjacent to the master drum, and on both sides of the master drum and the pressure roller there are situated a sheet supply means and a sheet discharge means.

A printing sheet supplied from the sheet supply means is fed as clamped between the master drum and the pressure roller, which are rotatable in synchronism with each other. To the printing sheet, the ink forced through a perforated image of the stencil is transferred. Then the printed sheet is peeled from the master drum to enter the sheet discharge means.

For obtaining a clear printed image by such conventional rotary mimeographic printing machine, the amount of ink to be transferred to the printing sheet must be controlled suitably. The amount of ink to be transferred to a printing sheet depends on the mechanical adjustment of the mimeographic printing machine and the quality of the printing sheet.

Conventionally, for mechanical adjustment of the amount of ink to be transferred to a printing sheet, it has been customary to adjust the pressure given between the stencil and the printing sheet by the pressure roller or to adjust the amount of ink to be supplied to the inside circumferential surface of the master drum by the ink supply means.

By the foregoing mechanical means, however, it was difficult to adjust the amount of ink to be transferred. For example, if the amount of ink to be transferred is reduced as the result of adjustment of the printing machine, the amount of ink transferred would be inadequate locally in the printed image which results in a blurred and hence unclear print. Yet if the amount of such ink could be increased in an attempt to improve this problem, such excessive ink would run on the printing paper. Besides, ink on a preceding printed sheet would tend to transfer to the back surface of a succeeding printed sheet,and on some occasions the image on the front surface of a printed sheet would be seen from the back side.

As mentioned above, the amount of ink to be transferred would be influenced also by the quality of a printing sheet, namely, the degree of ink absorption and/or smoothness of a printing sheet. In general, the smoother the printing sheet, the less the amount of ink will be transferred. Practically, however, there are an extremely wide variety of printing sheet qualities so that it is impossible to adjust the amount of ink, to be transferred based on the quality of the printing sheet. With the conventional rotary mimeographic printing machine, it is very difficult to provide a suitable amount of ink and to form a clear print image.

SUMMARY OF THE INVENTION

It is therefore an object of this invention to provide a machine in which a suitable amount of ink can be transferred to any kind of printing sheet, without causing ink on the previous printed sheet to be transferred to the back surface of the next printed sheet and without causing any ink running on a printed sheet so that the image on the front surface can been seen from the back side, thereby guaranteeing a high-quality print with fidelity to a stencil or master plate.

According to a first aspect of the invention, there is provided a mimeographic transfer printing machine comprising: stencil support means for supporting a stencil; ink supply means for forcing out ink through the stencil supported on the stencil supporting means; an ink receiving medium to which the ink forced out from the stencil is to be transferred; and sheet support means for supporting a printing sheet to which the ink on the ink receiving medium is to be transferred.

According to a second aspect of the invention, there is provided a mimeographic transfer printing machine comprising: rotary master drum means for supporting a stencil on its circumferential surface having an ink transmissive region; ink supply means in the master drum means for supplying ink through the master drum means from its inside circumferential surface to its outside circumferential surface to force out the ink through the stencil; a transfer drum which is rotatable in a direction opposite to the rotation of the master drum means in synchronism therewith and to which the ink forced out from the stencil on the master drum means is to be transferred; and a pressure drum rotatable in a direction opposite to the rotation of the transfer drum in synchronism therewith for feeding a printing sheet as clamped between the pressure drum and the transfer drum, whereby the ink on the transfer drum is transferred to the printing sheet.

Preferably, the ink supply means is adapted to push the circumferential surface of the master drum means outwardly against the transfer drum during printing.

Further, the master drum means includes base members or annular end frames having an axis of rotation and support circumferential surfaces and adapted to be driven for rotation about the axis of rotation, first holding means situated near the support circumferential surfaces of the base members for selectively holding a leading end of the stencil, and a master drum plate wound around the support circumferential surfaces and immovably situated at its leading end relative to the holding means and connected at its trailing end to a resilient member, whereby the resilient member is extendible to allow the master drum to slide on the support circumferential surfaces of the base members to bulge outwardly against the transfer drum when the ink supply means pushes out the circumferential surface of the master drum.

The mimeographic transfer printing machine includes a rubber sheet wound tensely around a circumferential surface of the transfer drum.

The pressure drum is equipped with second holding means for temporarily holding a leading end of the printing sheet supplied to the pressure drum.

The master drum is slightly larger in outside diameter than the transfer drum in such a manner that the circumferential speed of the master drum is greater than that of the transfer drum to give to the stencil on the master drum a tension acting in a direction opposite to the rotation of the master drum.

The transfer drum has an axis of rotation situated at a fixed position, and each of the ink supply means and the pressure drum is vertically movable to come into contact with the transfer drum.

Alternatively, the axis of rotation of each of the master drum and the pressure drum is situated at a fixed position, and the transfer drum is vertically movable at a predetermined timing to come into contact with the master drum and the pressure drum alternately.

In the mimeographic transfer printing machine, the master drum with a stencil wound around thereon and the transfer drum adjacent to the master drum rotate in opposite directions in synchronism with each other as they come in contact with each other. At that time, the ink supply means inside the master drum forces out ink from the mimeographic stencil through the ink transmissive region of the master drum. A constant amount of forced-out ink is transferred to the transfer drum in a clear pattern with fidelity. Then a printing sheet is supplied to the pressure drum to enter between the pressure drum and the transfer drum as they are rotating in opposite directions in synchronism with each other. Thus the printed sheet is fed as sandwiched between the transfer drum and the pressure drum. The ink on the transfer drum is transferred to the printing sheet to print a clear image with fidelity to the stencil.

DETAILED DESCRIPTION

Figure 1:
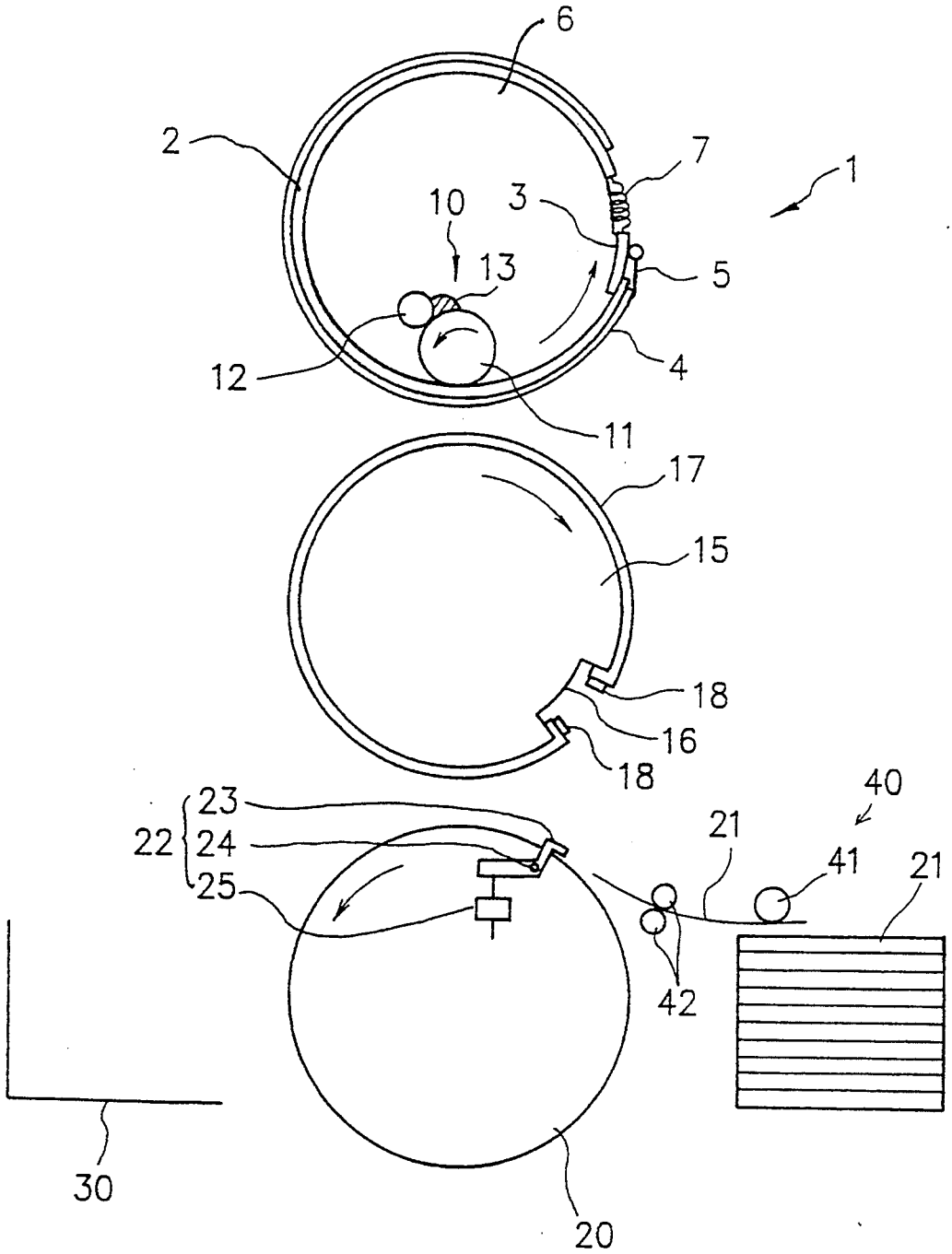
FIG. 1 is a schematic cross-sectional view of a mimeographic transfer printing machine according to one embodiment of this invention.

FIG. 1 shows a mimeographic transfer printing machine 1 according to one embodiment of this invention.

A cylindrical master drum 2, as a printing means, having an ink transmissive region is wound at opposite ends around a pair of annular end frames 6. The two annular end frames are interconnected with a predetermined distance therebetween by a master drum attachment plate 3 and is rotatable as a unit in a counterclockwise direction about a common axis of rotation in FIG. 1. A mimeographic stencil (hereinafter called "stencil") holding means in the form of a clamp plate 5 is pivotally mounted on the master drum attachment plate 3. The clamp plate 5 serves to hold one end of the stencil 4 by clamping jointly with the master drum attachment plate 3.

To a leading edge of the master drum attachment plate 3 with respect to the direction of rotation of the master drum 2, a leading end of the stencil 4 and a leading end of the master drum 2 are fixedly attached. The master drum 2 is in the form of a net, a porous plate or a combination of them and is wound around the outer circumferential surfaces of the opposite annular end frames 6. The trailing end of the master drum 2 is connected to the other edge of the master drum attachment plate 3 by a resilient connecting means such as a spring 7; when a pressure is exerted on the master drum 2 from the inside circumferential surface toward the outside circumferential surface, the spring 7 is extended to allow the master drum to bulge radially outwardly. Namely since the master drum 2 is wound around the opposite annular end frames and the master drum 2 is fixedly connected at one end to the master drum attachment plate 3 and is normally urged by the spring 7, the master drum 2 will bulge radially outwardly as it slides on the annular end frames in response to the pressure exerted on the inside circumferential surface of the drum.

An ink supply means 10 is situated inside the master drum 2. An ink supply roller 11 of the ink supply means 10 is in contact with the inside circumferential surface of the master drum 2 for rotation in the same direction with the master drum 2. Adjacent to the ink supply roller 11, an ink application roller 12 is situated at a position backwardly of the imaginary line extending between the axis of rotation of the master drum and the axis of rotation of the ink supply roller 11 with respect to the direction of rotation of the master drum 2. Between the ink supply roller 11 and the ink application roller 12, ink 13 is to be supplied from a non-illustrated ink source.

The ink supply roller 11 is pressed down against the inside circumferential surface of the master drum 2 in timed relation to the printing operation by a non-illustrated pressing mechanism,which is operable in response to the rotation of the master drum 2, to bulge a part of the master drum 2 outwardly. Then the stencil 4 wound on the bulged master drum 2 comes into contact with the circumferential surface of a transfer drum 15 as described below.

The transfer drum 15 is situated under the master drum 2 with a gap as of about 2 mm therewith. The transfer drum 15 has a drive shaft parallel to the axis of rotation of the master drum 2 for rotation in the direction opposite to the rotation of the master drum 2 in synchronism therewith.

In order to avoid any contact with the master drum attachment plate 3 of the master drum 2, the transfer drum 15 has in its outside circumferential surface a recess 16 at a position corresponding to the master drum attachment plate 3. On the outside circumferential surface of the transfer drum 15, a rubber sheet 17 as an ink receiving medium is wound in tension. The opposite end portions of the rubber sheet 17 are bent into recess 16 and are fixedly held by holding plates 18.

A pressure drum 20 as a printing sheet support means is situated under the transfer drum 15 with a predetermined gap therewith. The pressure drum 20 is a tubular body having a diameter substantially equal to that of the transfer drum 15 and the master drum 2. The pressure drum 20 is driven for rotation in a direction opposite to the rotation of the transfer drum 15 in synchronism therewith. The pressure drum 20 is movable upwardly and downwardly by a non-illustrated drive unit, in synchronism with the rotation about its own axis, to come into press contact with the transfer drum 15.

The pressure drum 20 is equipped with a means 22 for holding a printing sheet 21. A clamp claw 23 of the sheet holding means 22 partly projects from the circumferential surface of the pressure drum 20 and is pivotally movable about a pivot 24 to open and close by a control means 25. The operation of the control means 25 is such that the clamp claw 23 will close to catch a leading end of the printing sheet 21 to be supplied to the pressure drum 20 from the right side in FIG. 1 and will open to release the printing sheet 21 so that the printing sheet 21 is discharged to a sheet discharge tray 30 situated on the left side of the pressure drum 20 in FIG. 1.

In this embodiment, the master drum 2, the ink supply roller 11 inside the master drum 2, the transfer drum 15 and the pressure drum 20 are arranged in such a manner that their respective centers are vertically aligned with one another. Therefore, assuming that in FIG. 1 the master drum 2 and the pressure drum 20 are rotated counterclockwise while the transfer drum 15 is rotated clockwise, the ink application roller 12 inside the master drum 2 is situated on the left side of the imaginary line passing the centers of the master drum 2, the ink supply roller 11, the transfer drum 15 and the pressure drum 20 and, on the contrary, the printing sheet 21 is supplied to the pressure drum 20 from the right side and is discharged to the left side.

Thus a sheet supply unit 40 is situated on the right side of the pressure drum 20. An uppermost one of printing sheet stack 21 will be fed to the clamp claw 23 of the pressure drum 20 jointly by a sheet supply roller 41 and a pair of timing conveyer rollers 42. The sheet discharge tray 30 is situated on the left side of the pressure drum 20 for receiving successive printed sheets 21.

The outside diameter of the master drum 2 including the stencil 4, that of the transfer drum 15 including the rubber sheet 17, and that of the pressure drum 20 are almost equal to one another, and these three drums rotate at the same number of revolutions per minute.

The operation of this printing machine will now be described.

A stencil 4 containing a perforated image is wound around the outside circumferential surface of the master drum 2, and then the printing machine is started. Meanwhile, a printing sheet 21 fed by the sheet supply roller 41 and conveyed by the timing conveyer rollers 42 is fed to the holding means 22 of the pressure drum 20. Then the leading end of the printing sheet 21 is caught by the clamp claw 23 on the rotating pressure drum 20. At this moment, the feeding speed of the printing sheet 21 should be a little higher than the rotational speed of the pressure drum 20.

The master drum 2 and the transfer drum 15 are rotating in synchronism with the feed of the printing sheet 21. Simultaneously, the ink supply roller 11 inside the master drum 2 rotates while ink 13 is applied onto the ink supply roller 11 by the ink application roller 12. The ink supply roller 11 is pressed against the inside circumferential surface of the master drum 2 at a predetermined timing by the non-illustrated pressing mechanism. The master drum 2 is thereby bulged outwardly to bring the stencil 4, which is wound around the master drum 2, against the rubber sheet 17 on the transfer drum 15 so that the perforated image of the stencil 4 is transferred as a reverse image to the rubber sheet 17.

When the clamp claw 23 of the pressure drum 20 meets the recess 16 of the transfer drum 15 after the leading end of the printing sheet 2 is held by the clamp claw 23 as the pressure drum 20 and the transfer drum 15 corotate, the pressure drum 20 is pressed against the rubber sheet 17 of the transfer drum 15 by a non-illustrated drive unit. The printing sheet 21 on the pressure drum 20 is sandwiched between the pressure drum 20 and the rubber sheet 17 of the transfer drum 15 and is then conveyed leftwardly in FIG. 1 to the sheet discharge tray 30 in response to the corotation of the pressure drum 20 and the transfer drum 15. As the result of this operation, the reverse image on the rubber sheet 17 is transferred to the printing sheet 21 as a corrected image.

When the leading end of the printed sheet 21 approaches the sheet discharge tray 30, the clamp claw 23 will be opened to release the printed sheet 21. As its trailing end is separated off the transfer drum 15 and the pressure drum 20, the printed sheet 21 will then fall down on the top of the sheet stack in the sheet discharge tray 30.

According to this printing operation, the amount of ink to be transferred from the master drum 2 to the transfer drum 15 is kept constant. During this ink transfer, since ink is forced out through the perforated region of the stencil 4 in a simple mechanical action, it is easy to control the amount of ink to be transferred. Then the ink forced out from the master drum 2 will be transferred to the rubber sheet 17, whose quality is constant all times so that print quality is not influenced by the sheet quality unlike the conventional art in which ink on the master drum is transferred directly to the printing sheet.

Since the objective to which the ink forced out from the master drum 2 is the rubber sheet 17, the transferred ink is free from running or blurring on the rubber sheet 17, and it is possible to transfer the perforated image of the stencil 4 to the printing sheet with fidelity. Otherwise if ink on the master drum was transferred directly to the printing sheet, a clear exact image could not have been obtained due to the ink running.

As mentioned above, since the amount of ink to be transferred is kept constant, the image transferred from the master drum 2 to the rubber sheet 17 of the transfer drum 15 is free from any running and is an exact copy of the image of stencil.

In the printing method of this embodiment, since the amount of ink to be transferred to the rubber sheet 17 is constant all times, and only part of the ink transferred to the rubber sheet 17 is transferred to the printing sheet 21, the image on the printing sheet 21 is formed of a relatively small amount of ink as compared to the direct-transfer method of the conventional art, thus improving the resolution. Accordingly it is possible to prevent ink on the front surface of a preceding printed sheet from being inadvertently transferred to the back surface of a succeeding printed sheet and also to avoid a poor quality print in which the ink on the front surface of a printed sheet can be seen from the back side.

According to the conventional mimeographic printing, the print image had many small spots, called white spots, devoid of ink in the area where ink should have been transferred all over. This is true partly because the stencil generally contains Japanese tissue or the like as the backing of a heatsensitive film and partly because ink forced out from the stencil is transferred directly to the printing sheet. When a perforated image is formed in the heatsensitive film, some Japanese tissue fibers stay in the perforated areas to obstruct passage of ink, thus causing white spots devoid of ink.

Whereas according to this embodiment, though using the mimeographic stencil 4, the foregoing conventional problems have been overcome. Ink is transferred from the stencil 4 to the printing sheet 21 via the rubber sheet 17 rather than directly. If white spots exist in the transferred image on the rubber sheet 17, spaces in ink corresponding to such white spots will disappear as collapsed while being transferred to the printing sheet 21. Therefore, this embodiment has no problem of the white spots though using the mimeographic stencil 4.

In the illustrated embodiment, the master drum 2, the transfer drum 15 and the pressure drum 20 have the same outside diameter and rotate at the same number of revolutions per minute. Alternatively, there may be provided a difference in circumferential speed between the master drum 2 and the transfer drum 15 to give a tension to the stencil 4 on the master drum 2 so that the stencil 4 is prevented from becoming wavy or wrinkled. For example, such circumferential difference may be provided if the master drum 2 and the transfer drum 15 have the same number of revolutions per minute and if the outside diameter of the master drum 2 including the stencil 4 is slightly larger than that of the transfer drum 15 including the rubber sheet 17, thus giving to the stencil 4 a tension acting in a direction opposite to the rotation of the master drum 2.

According to this embodiment, the ink supply roller 11 pushes the inside circumferential surface of the master drum 2 outwardly to press the master drum 2 against the transfer drum 15, and meanwhile the pressure drum 20 moves to sandwich a printing sheet between the pressure drum 20 and the transfer drum 15. However, the mutual movement of the individual drums may be set up as desired. For example, the axis of rotation of the transfer drum 15 may be situated at a fixed position, and the axis of rotation of each of the master drum 2 and the pressure drum 20 may be vertically movable toward and away from the axis of rotation of the transfer drum 15. To the contrary, the axis of rotation of each of the master drum 2 and the pressure drum 20 is situated at its respective fixed position, and the axis of rotation of the transfer drum 15 is vertically movable at a suitable timing to contact the master drum 2 and the pressure drum 20 alternately.

Further, the transfer drum 15 may have a radius larger than that of each of the master drum 2 and the pressure drum 20 and may have a generally D-shape contour, as viewed in end elevation, in which a part of circumference of a circle is cut off. In such event, the remaining arc of the transfer drum comes into press contact with the master drum 2 and the pressure drum 20 alternately so that it is unnecessary to move the axis of rotation of each of the ink supply roller, the master drum and the pressure drum in order to bring the ink supply roller, the master drum and the pressure drum respectively in contact with the transfer drum.

According to this embodiment, the printed sheet 21 is supported by the holding means 22 mounted on the pressure drum 20. Instead of the pressure drum 20, there may be provided a pressure roller which has no sheet holding means for pressing a printing sheet 21 against the transfer drum 15 and a separator claw for peeling a printing sheet 21 stuck on the transfer drum 15. However, if printing sheets take an inadequately firm stand, it is more useful to use the sheet holding means 22 so that the individual printed sheet will be discharged reliably, without any damage and irrespective of the sheet quality.

Moreover, the master drum 2 is supported at opposite ends on a base member in the form of a pair of interconnected annular end frames. In an alternative form, the base member may be a cylindrical tube having an ink transmissive circumferential surface on which the master drum 2 is to be wound.

As described above, according to this invention, since the ink which is forced out through the perforated image of a stencil and then transferred to the transfer drum is transferred to a printing sheet, it is possible to control the amount of ink to be transferred to the transfer drum whose quality is kept constant. Further, since the ink is transferred from the stencil to a printing sheet via the transfer drum rather than directly, it is possible to obtain a clear printed image which is free from ink running or back-surface soiling and which cannot be seen from the back side.

What is claimed is:

1. A mimeographic transfer printing machine comprising:

rotary master drum means including a plurality of base members each having a support circumferential surface and adapted to be driven for rotation; first holding means attached to the circumferential surfaces of the base members and adapted to selectively hold a leading edge of a stencil; a rotary drum wound around the support circumferential surfaces for supporting the stencil thereon and having leading and trailing ends, said leading end being immovably positioned relative to the first holding means; and a resilient member attached at one end to the trailing end of the rotary drum and immovably positioned at the other end relative to the first holding means to allow the rotary drum to slide around the support circumferential surfaces, ink supply means situated in said rotary master drum means for supplying ink to the stencil through the rotary drum, a transfer drum situated adjacent the rotary master drum means and rotatable in a direction opposite to a rotation of the rotary master drum means at an equal number of revolutions per minute therewith, said ink forced out from the stencil being transferred to an outer surface of the transfer drum, said transfer drum having a diameter smaller than that of the rotary master drum means so that when the rotary master drum means and the transfer drum rotate while contacting together, the circumferential speed of the rotary master drum means is greater than that of said transfer drum to provide to the stencil on the rotary drum a tension acting in a direction opposite to the rotation of the rotary master drum means, and a pressure drum situated adjacent to the transfer drum and having second holding means adapted to temporarily hold a leading end of a printing sheet supplied thereto, said pressure drum being rotatable in a direction opposite to the rotation of the transfer drum and synchronous therewith so that the printing sheet fed between the transfer drum and the pressure drum is transmitted while the ink on the transfer drum is transferred to the printing sheet.

2. A mimeographic transfer printing machine according to claim 1, wherein said transfer drum includes a recess at a position for allowing the first holding means of the rotary master drum means and the second holding means of the pressure drum to enter therein when the rotary master drum means, the transfer drum and the pressure drum rotate.

3. A mimeographic transfer printing machine according to claim 2, wherein said transfer drum includes a rubber sheet therearound, and holding plates situated in the recess for fixing the rubber sheet to the transfer drum.

* * * * *

UNITED STATES PATENT AND TRADEMARK OFFICE

CERTIFICATE OF CORRECTION

PATENT NO. : 5,373,785

DATED : December 20, 1994

INVENTOR(S) : Yasuo Yamamoto et al

It is certified that error appears in the above-identified patent and that said Letters Patent is hereby corrected as shown below:

Column 8,
Claim 1, lines 3 to 7, delete "plurality of base members each having a support circumferential surface and adapted to be driven for rotation; first holding means attached to the circumferential surfaces of the base members" and add --master drum attachment plate and two base members connected by said master drum attachment plate, said base members having support circumferential surfaces and adapted to be driven for rotation; first holding means attached to the master drum attachment plate--.

Signed and Sealed this

Twentieth Day of June, 1995

*Attest:*

Bruce Lehman

BRUCE LEHMAN

*Attesting Officer*

*Commissioner of Patents and Trademarks*